US010079475B2

(12) United States Patent
Ohta et al.

(10) Patent No.: US 10,079,475 B2
(45) Date of Patent: Sep. 18, 2018

(54) PLUG CONNECTOR, RUBBER MEMBER, AND RING MEMBER

(71) Applicant: NGK SPARK PLUG CO., LTD., Nagoya-shi, Aichi (JP)

(72) Inventors: Junpei Ohta, Kitanagoya (JP); Tomohiro Fuma, Ichinomiya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/307,400

(22) PCT Filed: May 13, 2015

(86) PCT No.: PCT/JP2015/063835
§ 371 (c)(1),
(2) Date: Oct. 28, 2016

(87) PCT Pub. No.: WO2015/178278
PCT Pub. Date: Nov. 26, 2015

(65) Prior Publication Data

US 2017/0054273 A1 Feb. 23, 2017

(30) Foreign Application Priority Data

May 19, 2014 (JP) ..... 2014-103862

(51) Int. Cl.
*H01R 13/44* (2006.01)
*F02M 57/06* (2006.01)
(Continued)

(52) U.S. Cl.
CPC ..... *H01T 13/04* (2013.01); *F02P 13/00* (2013.01); *H01R 13/533* (2013.01)

(58) Field of Classification Search
CPC .. F02P 13/00; F02P 1/16; H01T 13/02; H01T 13/06; H01T 13/20; H01T 13/54;
(Continued)

(56) References Cited

U.S. PATENT DOCUMENTS 3,219,864 A 11/1965 Allman
4,621,881 A 11/1986 Johansson et al.
(Continued)

FOREIGN PATENT DOCUMENTS

DE 3701396 A1 7/1988
EP 0851550 A1 7/1998
(Continued)

OTHER PUBLICATIONS

International Search report issued in corresponding International Patent Application No. PCT/JP2015/063835, dated Jun. 23, 2015.
(Continued)

*Primary Examiner* — Michael A Lyons
*Assistant Examiner* — Milagros Jeancharles
(74) *Attorney, Agent, or Firm* — Kusner & Jaffe

(57) ABSTRACT

A plug connector capable of increasing the sealing between a rubber member and an outer circumferential surface of a spark plug insulator for improvement in current leakage resistance. The plug connector includes a conductive part that electrically connects a spark plug and a power supply member for power supply to the spark plug; and a rubber member that covers the conductive part. The spark plug has an insulator and a terminal electrode protruding toward the rear from a rear end of the insulator. The plug connector further includes a ring member arranged on an outer circumference of the rubber member.

9 Claims, 10 Drawing Sheets

(51) Int. Cl.
*H01T 13/04* (2006.01)
*F02P 13/00* (2006.01)
*H01R 13/533* (2006.01)

(58) Field of Classification Search
CPC ..... H01T 13/56; H01R 13/04; H01R 13/502; H01R 13/533
USPC ..... 439/125–128; 313/118, 135–137, 144
See application file for complete search history.

(56) References Cited

U.S. PATENT DOCUMENTS 4,746,834 A * 5/1988 Bauerle ..... H01T 13/40 313/137
4,997,380 A * 3/1991 Etienne ..... H01T 13/04 439/127
5,145,433 A * 9/1992 Yagi ..... H01T 13/05 264/272.16
5,297,971 A * 3/1994 Nitta ..... H01R 13/53 439/125
5,358,415 A * 10/1994 Nitta ..... H01R 13/53 439/125
5,447,429 A * 9/1995 Nitta ..... H01R 13/53 439/125
5,716,223 A * 2/1998 Phillips, Jr. ..... H01T 13/06 439/125
5,813,872 A * 9/1998 Evans ..... H01T 13/06 439/125
5,975,926 A 11/1999 Uchiyama et al.
5,979,049 A * 11/1999 Evans ..... H01T 13/06 29/887
6,340,303 B2 * 1/2002 Hamada ..... H01R 13/2421 439/127
8,198,791 B2 * 6/2012 Suzuki ..... H01T 21/02 313/118
8,384,277 B2 * 2/2013 Yamada ..... H01T 13/02 313/118
8,970,097 B2 * 3/2015 Yamada ..... H01T 13/08 313/118

FOREIGN PATENT DOCUMENTS

JP S52-019685 U 2/1977
JP H06-84580 A 3/1994 ..... F02P 13/00
JP 2002-151231 A 5/2002 ..... F02P 13/00
WO WO-85/00931 A1 2/1985

OTHER PUBLICATIONS

Extended European Search Report issued in corresponding European Patent Application. No. 15796380.2 dated Dec. 22, 2017.

* cited by examiner

FIRST EMBODIMENT

SECOND EMBODIMENT

THIRD EMBODIMENT

FOURTH EMBODIMENT

A-A CROSS SECTION

A-A CROSS SECTION
(BEFORE ATTACHMENT OF RING MEMBER)

MODIFICATION EXAMPLES

PLUG CONNECTOR, RUBBER MEMBER, AND RING MEMBER

RELATED APPLICATIONS

This application is a National Stage of International Application No. PCT/JP2015/063835 filed May 13, 2015, which claims the benefit of Japanese Patent Application No. 2014-103862, filed May 19, 2014.

FIELD OF THE INVENTION

The present invention relates to a plug connector such as a plug cap for connection to a spark plug. The present invention also relates to a rubber member and a ring member of the plug connector.

BACKGROUND OF THE INVENTION

A spark plug is used in an internal combustion engine, with a plug connector such as plug cap or plug cord attached to the spark plug. For example, there is known a plug cap of the type that includes: a hollow insulating member made of a rubber material (hereinafter referred to as "rubber member") and having a front end portion engageable with a terminal electrode of a spark plug and a rear end portion engageable with a high-voltage cord for power supply to the spark plug; and a resistor disposed in a hollow portion of the rubber member (see e.g. Japanese Unexamined Utility Model Application Publication No. S52-19685). This plug cap establishes a seal between the rubber member and an outer circumferential surface of an insulator of the spark plug by contact of the front end portion of the rubber member with the outer circumferential surface of the insulator of the spark plug, so as to prevent current leakage (i.e. leakage of electric current) through between an inner circumferential surface of the rubber member and the outer circumferential surface of the insulator.

By the way, the compression ratio of internal combustion engines has recently been increased for the purpose of fuel efficiency improvements. In such internal combustion engines, there is a tendency that the operating voltage of spark plugs becomes high. It is thus demanded to provide plug caps with higher current leakage resistance.

An advantage of the present invention is a plug connector capable of increasing the sealing between a rubber member and a spark plug insulator for improvement in current leakage resistance.

SUMMARY OF THE INVENTION

The present invention has been made to address at least part of the above problems and can be embodied as the following application examples.

Application Example 1

In accordance with a first aspect of the present invention, there is provided a plug connector, comprising:

a conductive part that provides electrical connection between a spark plug and a power supply member for power supply to the spark plug, the spark plug comprising an insulator and a terminal electrode protruding toward the rear from a rear end of the insulator; and a rubber member that covers the conductive part, wherein the plug connector further comprises at least one ring member arranged on an outer circumference of the rubber member and having higher hardness than that of the rubber member; and wherein a front end of the at least one ring member is located on a front side with respect to the rear end of the insulator.

In the above configuration, the contact pressure between an inner circumferential surface of the rubber member and an outer circumferential surface of the insulator of the spark plug is increased by the ring member. It is therefore possible to increase the sealing between the rubber member and the spark plug and improve the current leakage resistance of the plug connector.

Application Example 2

In accordance with a second aspect of the present invention, there is provided a plug connector according to Application Example 1, wherein the conductive part includes a metal connector member connectable to the terminal electrode; and wherein a rear end of the at least one ring member is located on a rear side with respect to a front end of the metal connector member.

Vibration of the plug connector leads to the generation of a powder (e.g. metal powder) from the conductive part inside the plug connector. Such a metal powder becomes a cause of current leakage. In the above configuration, however, the rear end of the ring member, which is higher in hardness than the rubber member, is located on the rear side with respect to the front end of the metal connector member so that vibration of the plug connector is suppressed. It is thus possible to increase the vibration resistance of the plug connector for further improvement in current leakage resistance.

Application Example 3

In accordance with a third aspect of the present invention, there is provided a plug connector according to Application Example 1 or 2, further comprising a high hardness part arranged on an outer circumference of the conductive part and having higher hardness than that of the rubber member, wherein the rubber member covers the high hardness part.

In the above configuration, it is possible to increase the strength of the plug connector by the high hardness part.

Application Example 4

In accordance with a fourth aspect of the present invention, there is provided a plug connector according to Application Example 3, wherein a rear end of the at least one ring member is located on a rear side with respect to a front end of the high hardness part.

In the above configuration, the ring member, which is higher in hardness than the rubber member, is located on the rear side with respect to the front end of the high hardness part, which is higher in hardness than the rubber member, so that the vibration resistance of the plug connector is further increased. It is thus possible to further improve the current leakage resistance of the plug connector.

Application Example 5

In accordance with a fifth aspect of the present invention, there is provided a plug connector according to any one of Application Examples 1 to 4, wherein the rubber member has at least one of a recess and a protrusion formed on an outer circumferential surface thereof according to the shape of an inner circumferential surface portion including at least a part of an inner circumferential surface of the at least one ring member.

In the above configuration, it is possible to suppress displacement of the ring member relative to the rubber member.

Application Example 6

In accordance with a sixth aspect of the present invention, there is provided a plug connector according to Application Example 1, further comprising at least one of a metal connector member and a high hardness part, the metal connector member being connectable to the terminal electrode and covered by the rubber member, the high hardness part being arranged on an outer circumference of the conductive part and having higher hardness than that of the rubber member, wherein the at least one ring member includes a contact portion located at a position overlapping the at least one of the metal connector member and the high hardness part in an axis direction of the plug connector and brought into contact with an outer circumferential surface of the rubber member.

In the above configuration, the ring member is brought into contact with the rubber member at the location where the relatively hard ring member and the relatively hard metal connector member or high hardness part overlap in position in the axis direction. It is thus possible to further improve the vibration resistance of the plug connector.

Application Example 7

In accordance with a seventh aspect of the present invention, there is provided a plug connector according to Application Example 6, wherein, in a cross section taken through the contact portion in a direction perpendicular to the axis direction, an inner circumferential surface of the contact portion is in the shape of a first circle, and an outer circumferential surface of the at least one of the metal connector member and the high hardness part is in the shape of a second circle smaller in diameter than the first circle; and wherein the plug connector satisfies a condition of $0.97 \leq (S1/S2) \leq 0.99$ where, in the cross section, S1 is an area inside the first circle and outside the second circle; and S2 is an area of the rubber member before arrangement of the at least one ring member.

In the above configuration, the contact portion of the ring member is brought into contact with the rubber member at adequate pressure. It is thus possible to further improve the vibration resistance of the plug connector.

Application Example 8

In accordance with an eighth aspect of the present invention, there is provided a plug connector according to Application Example 6, wherein the contact portion has a first protrusion radially inwardly protruding from an inner circumferential surface thereof and brought into contact with the outer circumferential surface of the rubber member.

In the above configuration, the first protrusion of the contact portion of the ring member is brought into contact with the outer circumferential surface of the rubber member so that the contact pressure between the contact portion and the rubber member is stabilized. It is thus possible to further improve the vibration resistance of the plug connector.

Application Example 9

In accordance with a ninth aspect of the present invention, there is provided a plug connector according to Application Example 6 or 8, wherein the rubber member has a second protrusion protruding radially outwardly from the outer circumferential surface thereof and brought into contact with an inner circumferential surface of the contact portion.

In the above configuration, the second protrusion of the rubber member is brought into contact with the inner circumferential surface of the contact portion of the ring member so that the contact pressure between the contact portion and the rubber member is stabilized. It is thus possible to further improve the vibration resistance of the plug connector.

Application Example 10

In accordance with a tenth aspect of the present invention, there is provided a plug connector according to any one of Application Examples 6 to 9, wherein the contact portion has a length of 10 mm or smaller in the axis direction.

In the above configuration, the contact portion of the ring member is brought into contact with the rubber member at more adequate pressure. It is thus possible to further improve the vibration resistance of the plug connector.

Application Example 11

In accordance with an eleventh aspect of the present invention, there is provided a rubber member for covering a conductive part that provides electrical connection between a spark plug and a power supply member for power supply to the spark plug, the spark plug comprising an insulator and a terminal electrode protruding toward the rear from a rear end of the insulator, wherein the rubber member includes one end portion in which the spark plug is inserted with a ring member arranged on the rubber member so as to increase a contact pressure between the insulator and the rubber member; and wherein the rubber member has at least one of a recess and a protrusion formed on an outer circumferential surface thereof according to the shape of an inner circumferential surface portion including at least a part of an inner circumferential surface of the ring member.

In the above configuration, the ring member is arranged on the outer circumference of the rubber member to enhance the press contact between the insulator of the spark plug and the rubber member. Further, displacement of the ring member relative to the rubber member is suppressed by the recess or protrusion. It is therefore possible to increase the sealing between the rubber member and the spark plug for improvement in current leakage resistance.

Application Example 12

In accordance with a twelfth aspect of the present invention, there is provided a ring member for use with a rubber member, the rubber member covering a conductive part that provides electrical connection between a spark plug and a power supply member for power supply to the spark plug, the spark plug comprising an insulator and a terminal electrode protruding toward the rear from a rear end of the insulator, wherein the ring member is arranged on an outer circumference of the rubber member so as to, when the spark plug is inserted in one end portion of the rubber member, increase a contact pressure between the insulator and the rubber member.

In the above configuration, the ring member is arranged to enhance the press contact between the insulator of the spark plug and the rubber member. It is therefore possible to increase the sealing between the rubber member and the spark plug for improvement in current leakage resistance.

Application Example 13

In accordance with a thirteenth aspect of the present invention, there is provided a ring member according to Application Example 12, wherein the ring member has at least one of a recess and a protrusion formed on an inner circumferential surface thereof.

In the above configuration, it is possible to suppress displacement of the ring member relative to the rubber member by the recess or protrusion.

It should be noted that the present invention can be embodied in various forms such as not only a plug cap for a spark plug but also a plug cord for a spark plug, an ignition coil unit for a spark plug and the like.

DETAILED DESCRIPTION OF THE PREFERRED EMBODIMENTS

A. First Embodiment

A-1. Overall Structure of Plug Cap 100

Figure 1B:
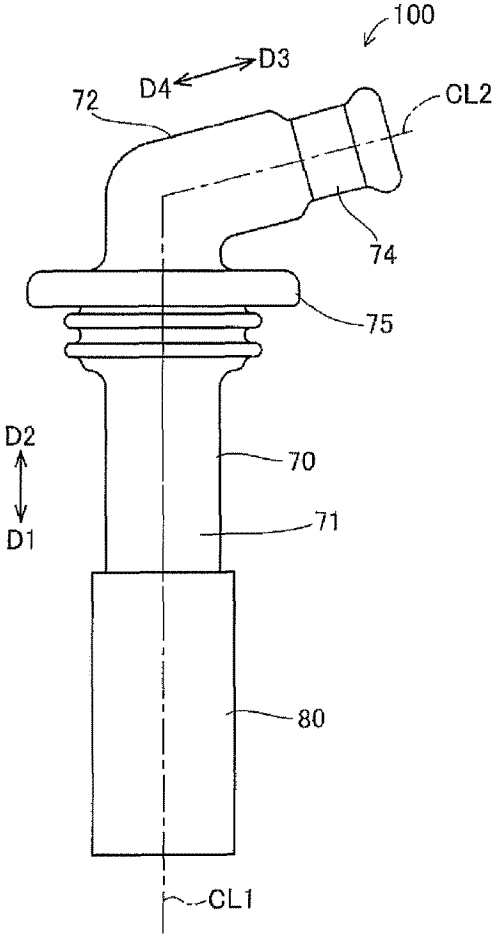
FIG. 1 is a schematic view of a plug cap 100 according to a first embodiment of the present invention.

Hereinafter, a first embodiment of the present invention will be described below. FIG. 1 shows a plug cap 100 according to the first embodiment of the present invention, where FIG. 1(A) is a cross-sectional view of the plug cap 100; and FIG. 1(B) is an external view of the plug cap 100.

Figure 1A:
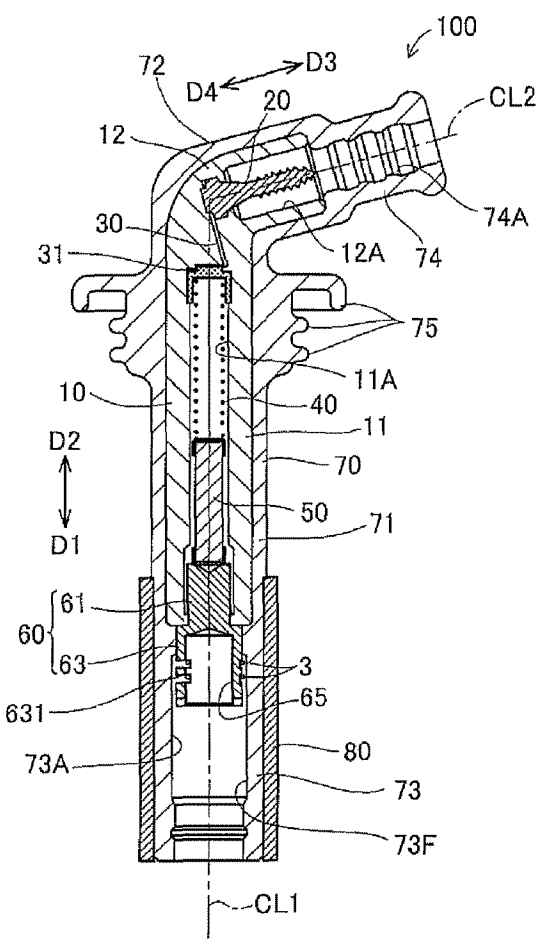

As shown in FIG. 1A, the plug cap 100 includes a resin part 10, a cord fixing screw 20, a metal plate 30, a connection spring 40, a resistor 50, a metal connector member 60, a rubber member 70 and a ring member 80 in the first embodiment.

The resin part 10 is made of a high heat-resistant thermosetting resin such as unsaturated polyester resin or phenol resin. Namely, the resin part 10 is made of a resin material having higher hardness than that of the rubber member 70. The resin part 10 is accordingly also called "high hardness part". The expression "hardness" used herein refers to a hardness value as measured according to the method defined by JIS K 6253:2012 (i.e. durometer type spring method).

The resin part 10 includes a first structure portion 11 formed in a cylindrical shape along a first axis CL1 and a second structure portion 12 formed in a cylindrical shape along a second axis CL2. Herein, the cylindrical shape is not necessarily perfect circular cylindrical and may be substantially cylindrical. For example, the outer or inner diameter of the cylindrical shape may vary depending on the position in the axis direction of the axis. It should be noted that: the direction toward the lower side of FIGS. 1(A) and 1(B) in parallel to the first axis CL1 is referred to as "first direction D1"; the direction toward the upper side of FIGS. 1(A) and 1(B) in parallel to the first axis CL1, i.e., the direction opposite to the first direction D1 is referred to as "second direction D2"; the direction from the lower left side to the upper right side of FIGS. 1(A) and 1(B) in parallel to the second axis CL2 is referred to as "third direction D3"; and the direction from the upper right side to the lower left side of FIGS. 1(A) and 1(B) in parallel to the second axis CL2 is referred to as "fourth direction D4". A second direction D2 end of the first structure portion 11 and a fourth direction D4 end of the second structure portion 12 are connected to each other.

In FIGS. 1(A) and 1(B), the angle formed between the first axis CL1 and the second axis CL2, i.e., the angle (minor angle) formed between the first structure portion 11 and the second structure portion 12 is set to about 100 degrees. The angle between the first and second structure portions 11 and 12 is not however limited to this value and may be set to any other value e.g. 60 degrees, 90 degrees or 120 degrees.

The first structure portion 11 has a first hole 11A formed therein with a first direction D1 end thereof open and a second direction D2 end thereof closed. The first hole 11A is circular cylindrical in shape along the first axis CL1.

The second structure portion 12 has a second hole 12A formed therein with a third direction D3 end thereof open and a fourth direction D4 end thereof closed. The second hole 12A is circular cylindrical in shape along the second axis CL2.

The cord fixing screw 20 is made of a conductive metal material (such as brass). The cord fixing screw 20 includes a head portion oriented in the fourth direction D4 and a male thread portion oriented in the third direction D3. The head portion of the cord fixing screw 20 is embedded in a region of the resin part 10 between the first hole 11A and the second hole 12A. The male thread portion of the cord fixing screw 20 is arranged inside the second hole 12A.

The cord fixing screw 20 is used to connect a plug cord (not shown) to the plug cap 100. Herein, the plug cord serves as a power supply member for power supply to a spark plug. At the time of connection of the plug cord to the plug cap 100, an end portion of the plug cord is inserted in the second hole 12A and screwed onto the cord fixing screw 20. By such screw connection, a lead wire inside the plug cord is electrically connected to the cord fixing screw 20.

The spring 40 is made of a conductive metal member (such as stainless steel) and is arranged inside the first hole 11A in a state of being compressed in the direction of the first axis CL1.

The metal plate 30 is made of a conductive metal material (such as brass) and is embedded in a region of the resin part 10 between the bottom of the first hole 11A and the bottom of the second hole 12A. A second direction D2 end of the metal plate 30 is brought into contact with the head portion of the cord fixing screw 20. A first direction D1 end of the metal plate 30 is exposed inside the first hole 11A and brought into contact with a spring bearing 31. The spring bearing 31 is provided with a recess such that the connection spring 40 is fixed in the spring bearing 31 by placing a second direction D2 end of the connection spring 40 in the recess and crimping the spring bearing 31 from the radially outer circumferential side.

The resistor 50 is cylindrical-shaped and arranged inside the first hole 11A at a location on the first direction D1 side with respect to the connection spring 40. A second direction D2 end of the resistor 50 is brought into contact with a first direction D1 end of the connection spring 40. The resistor 50 is made of a conductive ceramic material with a predetermined resistance (e.g. 5 kΩ) and is used for suppression of electrical noise.

The metal connector member 60 is made of a conductive metal material (such as brass) in a cylindrical shape. The metal connector member 60 includes a head portion 61 and an exposure portion 63 arranged on the first direction D1 side of the head portion 61. The head portion 61 is fixed by screwing in the first hole 11A of the first structure portion 11. A second direction D2 end of the head portion 61 is brought into contact with a first direction D1 end of the resistor 50.

The exposure portion 63 is exposed from the open end of the first hole 11A of the first structure portion 11, that is, protrudes in the first direction D1 from a first direction D1 end of the first structure portion 11.

A plug insertion hole 65 is formed in the exposure portion 63 such that, at the time of use of the plug cap 100, a terminal electrode on the rear end of the spark plug (not shown) is inserted in the plug insertion hole 65 from the first direction D1 side toward the second direction D2 side.

A groove 631 is formed in an outer circumference of the exposure portion 63 such that an annular connector spring 3 is engaged in the groove 631. A cut is formed in the groove 631 in communication with the plug insertion hole 65. A part of the connector spring 3, when engaged in the groove 631, is exposed to the plug insertion hole 65 through the cut. The terminal electrode of the spark plug inserted in the plug insertion hole 65 is fixed in the plug insertion hole 65 by the part of the connector spring 3 exposed to the plug insertion hole 65.

The cord fixing screw 20, the metal plate 30, the spring bearing 31, the connection spring 40, the resistor 50 and the metal connector member 60 are electrically conductive and electrically connected to one another. These conductive components 20 to 60 function together as a conductive part to provide electrical connection between the plug cord and the spark plug upon connection of the plug cord to the cord fixing screw 20 and connection of the spark plug to the metal connector member 60. By contrast, the resin part 10 functions as a resin insulator arranged around the conductive components 20 to 60.

The rubber member 70 is made of a rubber material such as silicone rubber. In the first embodiment, the rubber member 70 is arranged to cover not only the resin part 10 but also the whole of the conductive components 20 to 60. The rubber member 70 includes a first body portion 71 arranged on an outer circumference of the first structure portion 11 of the resin part 10 and a second body portion 72 arranged on an outer circumference of the second structure portion 12 of the resin part 10. The rubber member 70 also includes a plug cover portion 73 arranged on the first direction D1 side of the first body portion 71 and a cord cover portion 74 arranged on the third direction D3 side of the second body portion 72.

The plug cover portion 73 has a cylindrical shape with a hole 73A defined by an inner circumferential surface 73F thereof. In a state where the spark plug (see FIG. 2) is connected to the metal connector member 60 of the plug cap 100, the inner circumferential surface 73F of the plug cover portion 73 is brought into intimate contact with an outer circumferential surface of the spark plug so as to prevent the occurrence of current leakage through between the inner circumferential surface 73F and an outer circumferential surface of an insulator (insulating part) IN of the spark plug SP and to avoid the entry of water from the outside into the plug cap 100 and thereby reduce the possibility of current leakage caused by such water entry. In the first embodiment, the outer diameter of the first body portion 71 is set equal to the outer diameter of the plug cover portion 73. The cord cover portion 74 has a cylindrical shape with a hole 74A defined by an inner circumferential surface thereof. In a state where the plug cord (not shown) is connected to the cord fixing screw 20 of the plug cap 100, the inner circumferential surface of the cord cover portion 74 is brought into intimate contact with an outer circumferential surface of the plug cord so as to prevent the occurrence of current leakage and to avoid the entry of water from the outside into the plug cap 100.

As understood from the above explanation, the rubber member 70 is brought at one end portion (third direction D3 side portion) thereof into contact with the outer circumferential surface of the plug cord and at the other end portion (first direction D1 end portion) thereof into contact with the outer circumferential surface of the spark plug during use of the plug cap 100.

Moreover, a fixing portion 75 is formed on an outer circumference of the first body portion 71 such that the plug cap 100 is fixed in a plug hole of an internal combustion engine (not shown) by means of the fixing portion 75.

The ring member 80 is made of a material having higher hardness than that of the rubber member 70. For example, the ring member 80 can be made of a thermosetting resin such as unsaturated polyester resin or phenol resin as in the case of the resin part 10.

Figure 2:
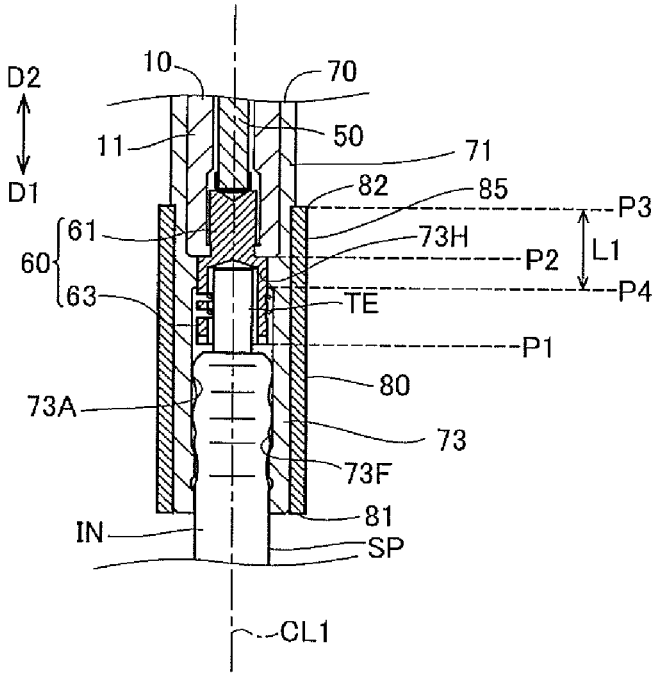
FIG. 2 is a schematic view of the vicinity of a ring member 80 of the plug cap 100 according to the first embodiment of the present invention.

The structure of the ring member 80 will be explained in more detail below with reference to FIG. 2. FIG. 2 is a cross-sectional view of the vicinity of the ring member 80 of the plug cap 100 in a state where the spark plug SP is connected to the plug cap 100 by insertion in one end portion (plug cover 73 side end portion) of the rubber member 70. As shown in FIG. 2, the spark plug SP has the insulator IN and the terminal electrode TE protruding toward the rear (second direction D2 side) from a rear end (second direction D2 end) of the insulator IN. The terminal electrode TE is inserted in the plug insertion hole 65 of the metal connector member 60. The insulator IN is arranged in the hole 73A of the plug cover portion 73. In this state, the outer circumferential surface of the insulator IN of the spark plug SP is brought into contact with the inner circumferential surface 73F of the plug cover portion 73.

The ring member 80 is arranged on an outer circumference of the rubber member 70 (more specifically, on outer circumferences of the first body portion 71 and the plug cover portion 73). The ring member 80 has a first direction D1 end 81 located at the same position in the axis direction (i.e. the direction of the axis CL1) as a first direction D1 end of the plug cover portion 73. In other words, the first direction D1 end 81 of the ring member 80 is located on the front side (first direction D1 side) with respect to the rear end (second direction D2 end) of the insulator IN of the spark plug SP in the axis direction during use of the plug cap.

On the other hand, the ring member 80 has a second direction D2 end 82 located on the second direction D2 side with respect to the position P1 of a first direction D1 end of the metal connector member 60 in the axis direction and, at the same time, on the second direction D2 side with respect to the position P2 of the first direction D1 end of the first structure portion 11 of the resin part 10 in the axis direction. Further, the second direction D2 end 82 of the ring member 80 is located on the first direction D1 side with respect to the second direction D2 end of the rubber member 70 in the axis direction.

As explained above, the outer circumferential surface of the insulator IN of the spark plug SP is brought into contact with the inner circumferential surface 73F of the plug cover portion 73 such that pressure is applied from the outer circumferential surface of the insulator IN to the inner circumferential surface 73F of the plug cover portion 73. In addition, the inner diameter of the ring member 80 is set smaller than the outer diameter of the plug cover portion 73 of the rubber member 70 such that pressure is applied from the inner circumferential surface of the ring member 80 to the outer circumferential surface of the plug cover portion 73.

In the first embodiment, the front end (first direction D1 end 81) of the ring member 80 is located on the front side (first direction D1 side) with respect to the rear end (second direction D2 end) of the insulator IN of the spark plug SP. That is, the insulator IN of the spark plug SP is arranged radially inside the inner circumferential surface of the ring member 80 with the rubber member disposed therebetween. As a result, the pressure of contact (contact pressure) between the inner circumferential surface 73F of the plug cover portion 73 of the rubber member 70 and the outer circumferential surface of the insulator IN of the spark plug SP is increased to increase the sealing between the rubber member and the spark plug and improve the current leakage resistance of the plug cap 100. More specifically, when the spark plug SP is inserted in one end portion of the rubber member 70, the ring member 80 prevents the plug cover portion 73 from expanding radially outwardly and thereby increases the contact pressure between the inner circumferential surface of the plug cover portion 73 and the outer circumferential surface of the insulator IN of the spark plug SP. It is therefore possible to increase the sealing between the rubber member and the spark plug and improve the current leakage resistance of the plug cap so that, for example, the entry of water into the plug cap 100 is avoided to suppress a flow of leak current.

Further, the rear end (second direction D2 end 82) of the ring member 80 is located on the rear side (second direction D2 side) with respect to the front end (first direction D1 end) of the metal connector member 60 (see FIG. 2). It is thus possible to further improve the current leakage resistance of the plug cap.

For more detailed explanation, assumed is the case where the ring member 80 is not provided or the case where the rear end of the ring member 80 is located on the front side with respect to the front end of the metal connector member 60. In these cases, vibration tends to become large at the position of the metal connector member 60, i.e., at the position of the terminal electrode TE of the spark plug SP because the plug cover portion 73 is made of relatively soft (low hardness) rubber. This vibration of the plug cap 100 leads to the generation of a powder from the conductive part (e.g. a metal powder from the metal connector member 60) inside the plug cap 100. The generated metal powder becomes a cause of current leakage. In the first embodiment, however, the rear end of the ring member 80, which is higher in hardness than the rubber member 70, is located on the rear side with respect to the front end of the metal connector member 60 so that vibration of the plug cap 100 is suppressed. It is thus possible to increase the vibration resistance of the plug cap 100, prevent the generation of a metal powder and thereby further improve the current leakage resistance of the plug cap 100.

The resin part 10 (high hardness part), which is higher in hardness than the rubber member 70, is provided in the plug cap 100. It is thus possible to increase the strength of the plug cap 100 so that, for example, the vibration resistance of the plug cap 100 is further increased to suppress the generation of a metal powder and improve the current leakage resistance.

Furthermore, the rear end (second direction D2 end 82) of the ring member 80 is located on the rear side with respect to the front end (first direction D1 end) of the resin part 10. That is, the rear end of the ring member 80, which is higher in hardness than the rubber member 70, is located on the rear side with respect to the front end of the resin part 10, which is higher in hardness than the rubber member 70. The ring member 80 and the resin part 10, both of which are relatively high in hardness, are arranged to overlap each other when viewed in the radial direction. In this arrangement, the entire outer circumference of the metal connector member 60 is covered by at least either the relatively hard ring member 80 or resin part 10 so that the vibration resistance of the plug cap 100 is further increased. It is thus possible to further improve the current leakage resistance of the plug cap 100.

B. Second Embodiment

Figure 3A:
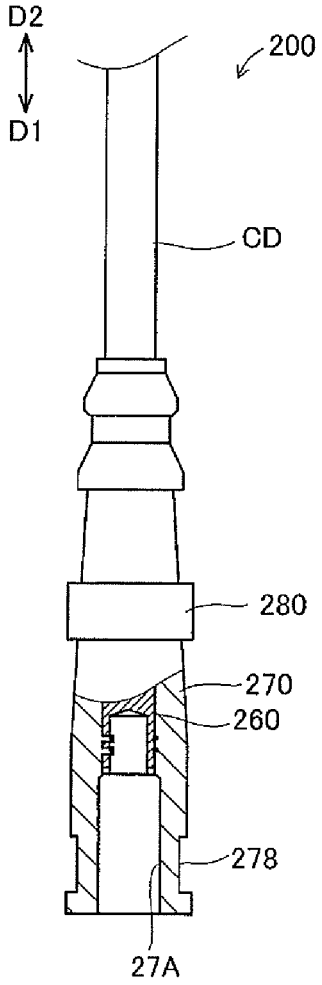
FIG. 3 is a schematic view of a plug cord 200 according to a second embodiment of the present invention.
Figure 3B:
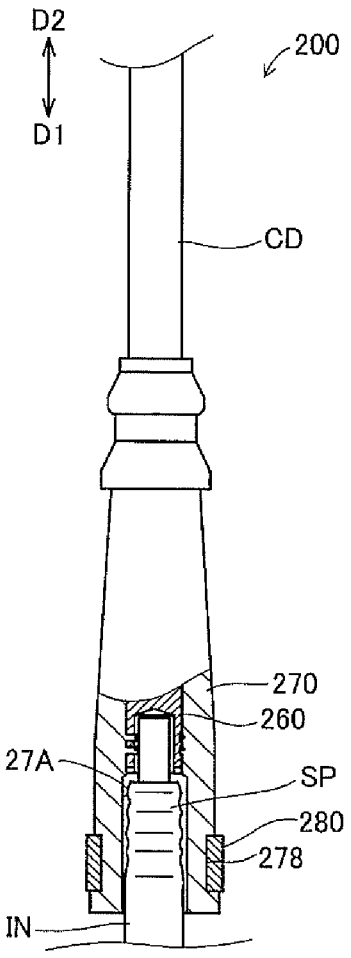

FIGS. 3(A) and 3(B) shows a plug cord 200 according to a second embodiment of the present invention, where FIG. 3(A) is a schematic view of the plug cord 200 in a state where a spark plug SP is not connected to the plug cord; and FIG. 3(B) is a schematic view of the plug cord 200 in a state where the spark plug SP is connected to the plug cord.

In the second embodiment, the plug cord 200 includes a cord body CD, a rubber member 270 arranged on the front side (first direction D1 side) of the cord body CD, a metal connector member 260 arranged inside the rubber member 270 and a ring member 280.

The rubber member 270 is made of a material similar to the material of the rubber member 70 of the first embodiment. The rubber member 270 has a cylindrical shape with its diameter gradually increasing from a second direction D2 end thereof toward the first direction D1. A hole 27A is formed in the rubber member 270 so as to be open in the front direction D1.

The metal connector member 260 is used for connection of a terminal electrode TE of the spark plug SP as in the case of the metal connector member 60 of the first embodiment. Although detailed illustration and explanation will be omitted herefrom, the cord body CD is electrically connected to a second direction D2 end of the metal connector member 260. Thus, the metal connector member 260 functions as a conductive part to provide electrical connection between the plug cord and the spark plug in the second embodiment. It can be said that the metal connector member 260 and the rubber member 270 are configured as a simple plug cap without the resistor 50 and the connection spring 40 according to a modification of the first embodiment.

A recess 278 is formed in a region of the outer circumferential surface of the rubber member 270 close to a first direction D1 end of the rubber member 270 over the entire circumference of the rubber member 270. As shown in FIG. 3(B), the position of the recess 278 in the axis direction corresponds to the position of an insulator IN of the spark plug SP in the state where the spark plug SP is connected to the plug cord 200.

The ring member 280 is made of a material similar to the material of the ring member 80 of the first embodiment, i.e., made of a material having higher hardness than that of the rubber member 270. In the second embodiment, the length of the ring member 280 in the axis direction is set substantially equal to the length of the recess 278 in the axis direction; and the inner diameter of the ring member 280 is set slightly smaller than the outer diameter of the recess 278. Namely, the recess 278 is shaped according to the shape of a portion including an inner circumferential surface of the ring member 280. The ring member 280 is hence shifted in the first direction D1 relative to the position of FIG. 2(A) and engaged in the recess 278.

As shown in FIG. 3(B), the terminal electrode TE of the spark plug SP is connected to the metal connector member 260 during use of the plug cord 200. Further, the ring member 280 is engaged in the recess 278 of the rubber member 270 during use. The inner circumferential surface of the ring member 280 is consequently brought into contact with the outer circumferential surface of the recess 278 of the rubber member 270 during use of the plug cord 200 such that pressure is applied from the inner circumferential surface of the ring member 280 to the outer circumferential surface of the recess 278.

As in the case of the plug cap 100 of the first embodiment, the plug cord 200 of the second embodiment is characterized in that the front end (first direction D1 end) of the ring member 280 is located on the front side (first direction D1 side) with respect to the rear end (second direction D2 end) of the insulator IN of the spark plug SP. As a result, the contact pressure between the inner circumferential surface of the rubber member 270 and the outer circumferential surface of the insulator IN of the spark plug SP is increased. It is therefore possible to increase the sealing between the rubber member 270 and the spark plug SP and improve the current leakage resistance.

Furthermore, the recess 278 is formed in the outer circumference of the rubber member 270 in accordance with the shape of a portion including an inner circumferential surface of the ring member 280. In this configuration, it is possible to suppress displacement of the ring member 280 relative to the rubber member 270 and avoid deterioration in the current leakage resistance of the plug cord 200 caused by displacement of the ring member 280 during use of the plug cord.

C. Third Embodiment

Figure 4:
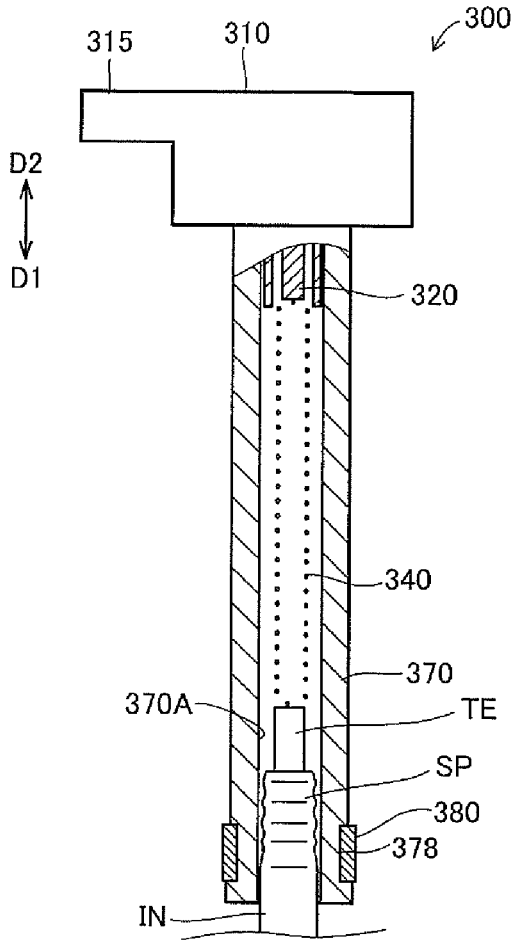
FIG. 4 is a schematic view of an ignition coil-integrated plug cap 300 according to a third embodiment of the present invention.

FIG. 4 is a schematic view of an ignition coil-integrated plug cap 300 according to a third embodiment of the present invention. The ignition coil-integrated plug cap 300 is used by insertion into a plug hole of an internal combustion engine (not shown). In the third embodiment, the ignition coil-integrated plug cap 300 includes a coil unit 310, a connection spring 340, a rubber member 370 and a ring member 380. The coil unit 310 has an ignition coil (not shown) installed therein, a connector 315 for connection of the ignition coil to a power source (e.g. battery) and an output terminal 320 for output of power supply from the ignition coil to a spark plug SP. The output terminal 320 thus functions as a power supply member for power supply to the spark plug SP in the third embodiment.

The rubber member 370 is made of a material similar to the material of the rubber member 70 of the first embodiment. The rubber member 370 has a cylindrical shape with a through hole 370A formed therein. The spark plug SP is inserted in the through hole 370A from a first direction D1 end of the rubber member 370. The output terminal 320 of the coil unit 310 is inserted in the through hole 370A from a second direction D2 end of the rubber member 370. A recess 378 is formed in a region of the outer circumferential surface of the rubber member 370 close to the first direction D1 end of the rubber member 370 over the entire circumference of the rubber member 370. As shown in FIG. 4, the position of the recess 378 in the axis direction corresponds to the position of an insulator IN of the spark plug SP in a state where the spark plug SP is connected to the ignition coil-integrated plug cap 300.

The connection spring 340 is arranged inside the through hole 370A of the rubber member 370, in a state of being compressed in the axis direction (first direction D1 and second direction D2), at a position between the output terminal 320 of the coil unit 310 and a terminal electrode TE of the spark plug SP. A second direction D2 end of the connection spring 340 is brought into press contact with the output terminal 320. A first direction D1 end of the connection spring 340 is brought into press contact with the terminal electrode TE of the spark plug SP. In the third embodiment, the connection spring 340 functions as a conductive part to provide electrical connection between the output terminal 320 and the spark plug SP.

The ring member 380 is made of a material similar to the material of the ring member 80 of the first embodiment. In the third embodiment, the length of the ring member 380 in the axis direction is set substantially equal to the length of the recess 378 in the axis direction; and the inner diameter of the ring member 380 is set slightly smaller than the outer diameter of the recess 378. Namely, the recess 378 is shaped according to the shape of a portion including an inner circumferential surface of the ring member 380. The ring member 380 is hence engaged in the recess 378.

As shown in FIG. 4, the terminal electrode TE of the spark plug SP is connected to the metal connector member 360 during use of the ignition coil-integrated plug cap 300. The inner circumferential surface of the ring member 380 is consequently brought into contact with the outer circumferential surface of the recess 378 of the rubber member 370 during use of the ignition coil-integrated plug cap 300 such that pressure is applied to the outer circumferential surface of the recess 378 as in the case of the second embodiment.

The ignition coil-integrated plug cap 300 of the third embodiment attains the same effects as the plug cord 200 of the second embodiment. More specifically, the ignition coil-integrated plug cap 300 of the third embodiment is also characterized in that the front end (first direction D1 end) of the ring member 380 is located on the front side (first direction D1 side) with respect to the rear end (second direction D2 end) of the insulator IN of the spark plug SP. As a result, the contact pressure between the inner circumferential surface of the rubber member 370 and the outer circumferential surface of the insulator IN of the spark plug SP is increased. It is therefore possible to increase the sealing between the rubber member 370 and the spark plug SP and improve the current leakage resistance.

Since the recess 378 is formed in the outer circumference of the rubber member 370, it is possible to avoid deterioration in the current leakage resistance of the ignition coil-integrated plug cap 300 caused by displacement of the ring member 380 during use of the ignition coil-integrated plug cap 300.

D. Fourth Embodiment

D-1. Structure

Figure 5:
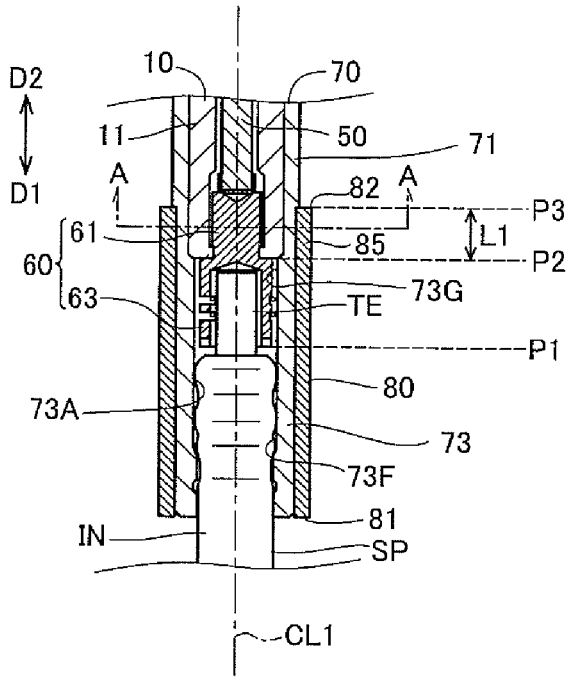
FIG. 5 is a schematic view of the vicinity of a ring member 80 of a plug cap according to a fourth embodiment of the present invention.

FIG. 5 is a cross-sectional view of the vicinity of a ring member 80 of a plug cap according to a fourth embodiment of the present invention. The fourth embodiment shown in FIG. 5 is different from the first embodiment shown in FIG. 2 in that a region 73G of the inner circumferential surface of the rubber member 70 is not brought into the metal connector member 60. The other configurations of the plug cap of the fourth embodiment are the same as those of the first embodiment. In the fourth embodiment, the inner diameter of the rubber member 70 before attachment to the resin part 10 is set smaller than the outer diameter of the resin part 10 (first structure portion 11) and greater than the outer diameter of the exposure portion 63 of the metal connector member 60. The inner circumferential surface of the rubber member 70 is consequently brought into contact with the outer circumferential surface of the resin part 10 (first structure portion 11) at a certain degree of pressure. It is thus unlikely that the rubber member 70 will be circumferentially inwardly deformed.

Further, the inner diameter of the ring member 80 is set smaller than or equal to the outer diameter of the rubber member 70 after attachment to the resin part 10 (first structure portion 11), i.e., the outer diameter of a region of the rubber member 70 from the axial position P2 to the axial position P3 in FIG. 5. The inner circumferential surface of a region of the ring member 80 from the axial position P2 to the axial position P3 in FIG. 5 is hence securely brought into contact with the outer circumferential surface of the rubber member 70 at a certain degree of pressure. In the fourth embodiment, the axial position P2 corresponds to the position of the front end of the resin part 10 (first structure portion 11); and the axial position P3 corresponds to the position of the rear end of the ring member 80.

The portion of the ring member 80 extending from the axial position P2 to the axial position P3 for secure contact with the outer circumferential surface of the rubber member 70 is herein called "contact portion 85". The resin part 10 (first structure portion 11) is one example of high hardness part that is arranged around the outer circumference of the conductive part (such as resistor 50) and covered by the rubber member 70 and has higher hardness than that of the rubber member 70.

It can be said that the contact portion 85 is located at a position axially overlapping the resin part 10, as the high hardness part, and brought into contact with the outer circumferential surface of the rubber member 70. The length of the contact portion 85 in the axis direction is defined as "contact length L1". As there is a clearance left between the inner circumferential surface of the rubber member 70 and the outer circumferential surface of the exposure portion 63 of the metal connector member 60 on the front side with respect to the axial position P2 in FIG. 5, the contact between the inner circumferential surface of the rubber member 70 and the outer circumferential surface of the exposure portion 63 of the metal connector member 60 is not secured. In consequence, the contact between the inner circumferential surface of the ring member 80 and the outer circumferential surface of the rubber member 70 is not secured on the front side with respect to the axial position P2 in FIG. 5.

In the fourth embodiment, the contact portion 85 is provided in the plug cap so that the ring member 80 is brought into contact with the rubber member 70 at the location where two component parts of relatively high hardness (that is, the resin part 10 and the ring member 80) axially overlap in position as explained above. It is therefore possible to enhance the mating between the resin part 10 and the ring member 80 and further improve the vibration resistance of the plug cap.

D-2. Evaluation Test

Twelve kinds of samples of the plug cap according to the fourth embodiment (referred to as "evaluation samples") and one kind of comparative plug cap sample (referred to as "comparative sample") were prepared and evaluated by vibration test. Herein, the dimensions of the ring member 80 were varied among the twelve kinds of evaluation samples.

Figure 6A:
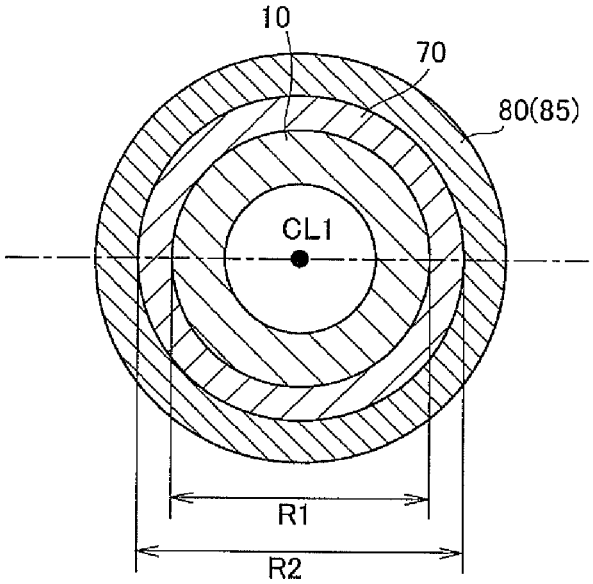
FIG. 6 is a cross-sectional view of the plug cap according to the fourth embodiment of the present invention, as taken along line A-A of FIG. 5.
Figure 6B:
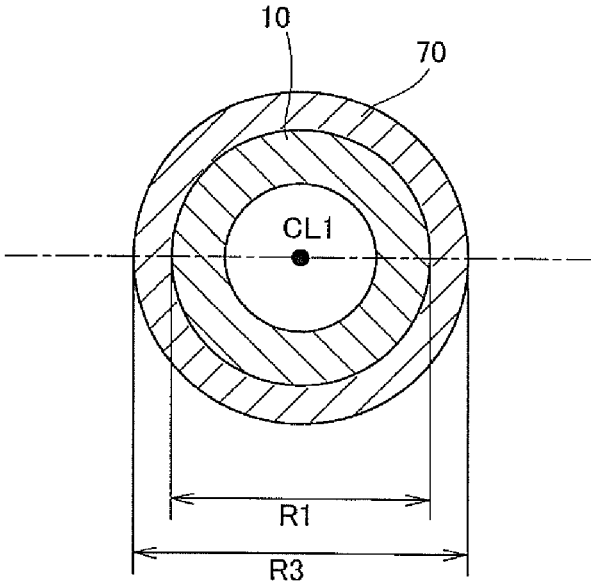

FIGS. 6(A) and 6(B) shows a cross section of the plug cap as taken along line A-A of FIG. 5. More specifically, FIG. 6(A) is a cross-sectional view of the plug cap as taken along line A-A of FIG. 5, i.e., as taken though the contact portion 85 in the direction perpendicular to the axis direction. FIG. 6(B) is a cross-sectional view of the plug cap as taken along line A-A of FIG. 5 in a state where the ring member 80 is not yet arranged. For the sake of simplification of illustration, the metal connector member 60 is omitted from FIGS. 6(A) and (B). As shown in FIGS. 6(A) and (B), each of the outer circumferential surface of the resin part 10 (first structure portion 11), the outer circumferential surface of the rubber member 70 and the inner circumferential surface of the contact portion 85 of the ring member 80 is circular in cross section. It is now assumed that: R1 is the outer diameter of the resin part 10 (first structure portion 11) as shown in FIGS. 6(A) and (B); R2 is the inner diameter of the ring member 80 (contact portion 85) as shown in FIG. 6(A); and R3 is the outer diameter of the rubber member 70 in an uncompressed state as shown in FIG. 6(B). The uncompressed state herein refers to a state where the ring member 80 is not arranged on the outer circumference of the rubber member 70, that is, the rubber member 70 is not compressed radially inwardly by the inner circumferential surface of the ring member 80.

The configurations common to the twelve kinds of evaluation samples are as follows.

Outer diameter R1 of resin part 10: 12 mm

Outer diameter R3 of rubber member 70 in uncompressed state: 16 mm

Material of rubber member 70: silicone rubber (A60)

Material of ring member 80: phenol resin

Material of resin part 10: phenol resin

It is further assumed that: S1 is the area occupied by the rubber member 70, i.e., the area inside a circle representing the inner circumferential surface of the contact portion 85 and outside a circle representing the outer circumferential surface of the resin part 10 in the cross section of FIG. 6(A); and S2 is the area occupied by the rubber member 70, i.e., the area of the rubber member 70 in the uncompressed state in the cross section of FIG. 6(B).

There were provided four sample groups in which the ratio (S1/S2) was set to 0.97, 0.98, 0.99 or 1 by adjusting the inner diameter R2 of the ring member 80 and thereby changing the area S1. In the sample group in which the ratio (S1/S2) was set to 1, the outer diameter R3 of the rubber member 70 in the uncompressed state was equal to the inner diameter R2 of the ring member 80 (R3=R2) so that the outer circumferential surface of the rubber member 70 was brought into contact with the inner circumferential surface of the ring member 80 without the rubber member 70 being compressed radially inwardly by the ring member 80. In the sample groups in which the ratio (S1/S2) was set smaller than 1, i.e., set to 0.97, 0.98 or 0.99, the inner diameter R2 of the ring member 80 was smaller than the outer diameter R3 of the rubber member 70 in the uncompressed state (R3<R2) so that the rubber member 70 was compressed radially inwardly by the inner circumferential surface of the ring member 80. The smaller the ratio (S1/S2), the greater the degree of compression of the rubber member 70.

Each of the four sample groups of different ratio values (S1/S2) was provided with three kinds of samples. In these three kinds of samples of each sample group, the contact length L1 shown in FIG. 5 was set to different values of 5 mm, 10 mm and 15 mm. The evaluation samples with a ratio value (S1/S2) of 0.96 or smaller were not provided because the inner diameter R2 of the ring member 80 was too small relative to the outer diameter R3 of the rubber member 70 so that it was impossible to arrange the ring member 80 around the rubber member 70.

The configurations of the comparative sample were the same as those of the evaluation samples except that the ring member 80 was not arranged.

The vibration test was performed on each of the evaluation samples and the comparative sample by mounting a front end portion of a spark plug SP to a vibration test machine, with the sample attached to the spark plug SP, and then, vibrating the spark plug SP in a direction perpendicular to the axis direction. In this test, the spark plug SP was subjected to log sweep vibration with an acceleration of 30 G. The log sweep vibration was herein applied by 20 hours of repeated vibration cycles, in each of which frequency was increased from 50 Hz to 500 Hz at a logarithmic sweep rate and then decreased from 500 Hz to 50 Hz at a logarithmic sweep rate. One cycle was conducted over 6 minutes. After applying the vibration, the plug cap sample was detached from the spark plug SP and visually tested for the amount of a metal powder adhered to the inside of the rubber member 70. The metal powder was generated by shaving of the metal connector member 60 due to friction between a terminal electrode TE of the spark plug SP and the metal connector member 60. Since the metal powder becomes a cause of current leakage, it can be said that the less the amount of the metal powder generated by the vibration, the higher the vibration resistance of the sample.

In the comparative sample, there was found a large amount of the metal powder which could lead to a very high possibility of current leakage. The amount of the metal powder found in the evaluation sample was evaluated with reference to the amount of the metal powder found in the comparative example. The evaluation grade of the comparative sample was set as "D". The evaluation grade of the evaluation sample was set as "A" in the case where there was found almost no metal powder. The evaluation grade of the evaluation sample was set as "B" in the case where the metal powder was found in a slight amount but would not be a cause of current leakage. The evaluation grade of the evaluation sample was set as "C" in the case where the metal powder was found in a certain amount such that the possibility of current leakage could not be denied.

TABLE 1

| | | Surface ratio (S1/S2) | | | |
|---|---|---|---|---|---|
| | | 0.97 | 0.98 | 0.99 | 1 |
| Contact | 5 | A | A | A | C |
| length | 10 | A | A | A | C |
| L1 (mm) | 15 | B | B | B | C |

TABLE 1 shows the evaluation test results. All of the evaluation samples had an evaluation grade of "C" or higher. There was no evaluation sample with an evaluation grade of "D". It has been apparent from these results that it is possible to improve the vibration resistance of the plug cap by the arrangement of the ring member 80.

More specifically, the three evaluation samples in which the ratio (S1/S2) was 1 had an evaluation grade of "C" irrespective of the contact length L1. By contrast, the nine evaluation samples in which the ratio (S1/S2) was 0.99 or smaller had an evaluation grade of "B" or higher. In other words, the evaluation samples of 0.97≤(S1/S2)≤0.99 had higher vibration resistance than those of (S1/S2)=1.

The reason for this is assumed as follows. When the ratio (S1/S2) was smaller than or equal to 0.99, the rubber member 70 was compressed between the inner circumferential surface of the contact portion 85 and the outer circumferential surface of the resin part 10. In such a state, the contact pressures between the contact portion 85 and the rubber member 70 and between the resin part 10 and the rubber member 70 was secured adequately so as to enhance the mating between the relatively hard resin part 10 and ring member 80 and thereby more effectively suppress the friction between the terminal electrode TE of the spark plug SP and the metal connector member 60. Therefore, the vibration resistance of the plug cap was further improved.

Among the nine evaluation samples of 0.97≤(S1/S2)≤0.99, the six evaluation samples in which the contact length L1 was 5 mm or 10 mm had an evaluation grade of "A"; and the three evaluation samples in which the contact length L1 was 15 mm had an evaluation grade of "B". In other words, the evaluation samples in which the contact length L1 was smaller than or equal to 10 mm had higher vibration resistance than those in which the contact length L1 was greater than 10 mm.

The reason for this is assumed as follows. When the contact length L1 was greater than 10 mm, the mating force between the resin part 10 and the ring member 80 became excessive. Then, the so-called "play" between the resin part 10 and the ring member 80, by which vibration of the spark plug SP was absorbed, became too small so that vibration of the spark plug SP was directly transferred to the plug cap. The friction between the terminal electrode TE of the spark plug SP and the metal connector member 60 was therefore increased to cause deterioration in the vibration resistance of the plug cap.

As mentioned above, it has been shown by the evaluation test results that it is preferable for the plug cap of the fourth embodiment to satisfy the condition of 0.97≤(S1/S2)≤0.99. In this configuration, the contact portion 85 of the ring member 80 is brought into contact with the rubber member 70 at adequate pressure. It is thus possible to further improve the vibration resistance of the plug cap.

It has also been shown that it is preferable that the contact length L1 is smaller than or equal to 10 mm. In this configuration, the ring member 80 is brought into contact with the rubber member 70 at adequate pressure without causing excessive mating force between the resin part 10 and the ring member 80. It is thus possible to further improve the vibration resistance of the plug cap.

Figure 7A:
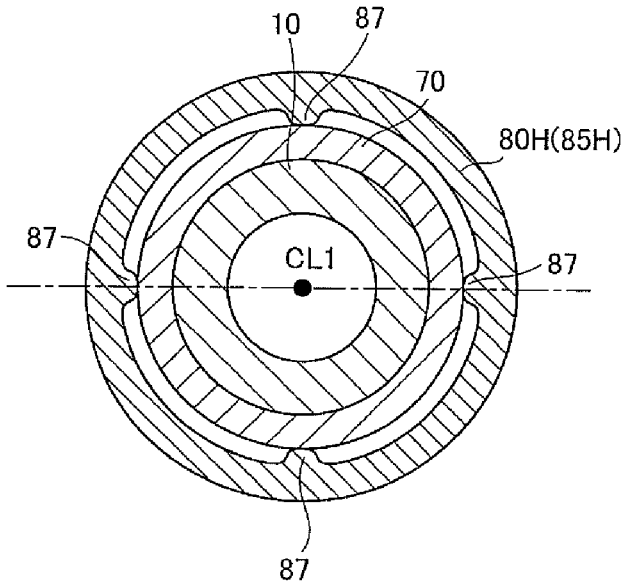
FIG. 7 is a cross-sectional view showing plug caps according to modifications of the present invention.

E. Modifications (1) In the above fourth embodiment, the inner circumferential surface of the ring member 80 is not necessarily circular in shape when viewed in cross section in the direction perpendicular to the axis direction. FIG. 7(A) shows a cross section of a modified example of the plug cap, as corresponding to the A-A cross section of FIG. 6(A). As in the case of FIG. 6(A), the metal connector member is omitted from FIG. 7(A). The ring member 80H of FIG. 7(A) has a plurality of radially inward protrusions 87 formed on an inner circumferential surface thereof. Radially inner ends of the plurality of protrusions 87 are brought into contact with the outer circumferential surface of the rubber member 70. The plurality of protrusions 87 extend over the entire length of the ring member 80 in the axis direction in this modified example. It is preferable that the plurality of protrusions 87 extend over at least the entire length of the contact portion 85 in the axis direction so as to secure the contact between the contact portion 85 of the ring member 80 and the outer circumferential surface of the rubber member 70. In the fourth embodiment, the whole of the inner circumferential surface of the contact portion 85 is brought into contact with the outer circumferential surface of the rubber member 70 so that there are likely to occur regions of high and low contact pressures. In consequence, the contact pressure between the contact portion 85 and the rubber member 70 may not be stabilized in the fourth embodiment. In this modified example, by contrast, the plurality of protrusion 87 of the contact portion 85 are brought into contact at radially inner sides thereof with the outer circumferential surface of the rubber member 70; and the other part of the contact portion 85 is not brought into contact with the rubber member 70. By such contact, the contact pressure between the contact portion 85 and the rubber member 70 is stabilized. It is thus possible to further improve the vibration resistance of the plug cap.

Although four protrusions 87 are spaced at equal intervals of 90 degrees, the arrangement and number of the protrusions 87 is not limited to this example. It is however preferable that the protrusions are spaced apart from each other in the circumferential direction. In the case where the ring member 80 has three protrusions 87, for example, it is preferable that these three protrusions 87 are spaced at intervals of 120 degrees. In general, in the case where the number of protrusions 87 is N (where N is an integer of 2 or greater), it is preferable that the protrusions 87 are spaced at intervals of (360/N) degrees.

Figure 7B:
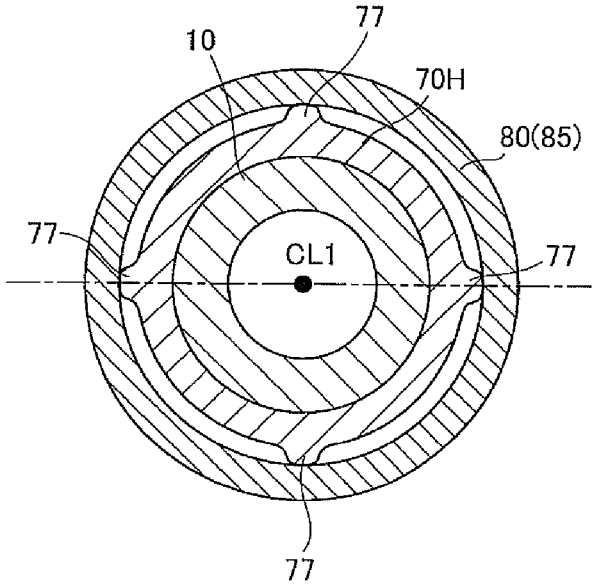

(2) In the above fourth embodiment, the outer circumferential surface of the rubber member 70 is not necessarily circular in shape when viewed in cross section in the direction perpendicular to the axis direction. The rubber member 70H of FIG. 7(B) has a plurality of radially outward protrusions 77 formed on an outer circumferential surface thereof. Radially outer ends of the plurality of protrusions 77 are brought into contact with the inner circumferential surface of the ring member 80 (contact portion 85). The plurality of protrusions 77 extend, at positions axially facing the outer circumference of the ring member 80, by a length corresponding to the entire length of the ring member 80 in the axis direction. It is preferable that the plurality of protrusions 77 extend, at positions facing at least the outer circumference of the contact portion 85, by a length corresponding to the entire length of the contact portion 85 so as to secure the contact between the inner circumferential surface of the contact portion 85 of the ring member 80 and the rubber member 70. In this modified example, the plurality of protrusion 77 of the ring member 70 are brought into contact at radially outer sides thereof with the inner circumferential surface of the ring member 80; and the other part of the rubber member 70 is not brought into contact with the ring member 80. By such contact, the contact pressure between the contact portion 85 and the rubber member 70 is stabilized. It is thus possible to stabilize further improve the vibration resistance of the plug cap.

Although four protrusions 77 are spaced at equal intervals of 90 degrees, the arrangement and number of the protrusions 77 is not limited to this example as in the case of the protrusions 87 of the above modified example (1). It is however preferable that the protrusions 77 are spaced apart from each other in the circumferential direction. In general, in the case where the number of protrusions 77 is N (where N is an integer of 2 or greater), it is preferable that the protrusions 77 are spaced at intervals of (360/N) degrees.

(3) The rubber member 70 is made of silicone rubber with a hardness of A60 in the above fourth embodiment. The material of the rubber member 70 is however not limited to the silicone rubber. Various insulating rubber materials are usable as the material of the rubber member 70. For example, the rubber member 70 can be made of ethylene-propylene-diene rubber (EPDM rubber). In general, the insulating rubber material does not include air bubbles so that the possible compression degree of the rubber material is substantially constant irrespective of the kind of the rubber material. For this reason, it is possible to ensure the high vibration resistance of the plug cap by satisfaction of $0.97 \leq (S1/S2) \leq 0.99$ irrespective of the kind of the rubber material.

(4) For secure contact between the contact portion 85 of the ring member 80 and the rubber member 70 in the fourth embodiment, the inner circumferential surface of the rubber member 70 is brought into contact with the outer circumferential surface of the resin member 10 so that the rubber member 70 is made unlikely to circumferentially inwardly deformed. It is feasible, by modifying the shape of the rubber member 70 or the shape of the exposure portion 63 of the metal connector member 60 and thereby bringing the inner circumferential surface of the rubber member 70 into contact with the outer circumferential surface of the exposure portion 63 of the metal connector member 60, to make the rubber member 70 unlikely to be circumferentially inwardly deformed. For example, the inner circumferential surface of some region 73H of the rubber member 70 is brought into contact with the outer circumferential surface of the rear end region of the exposure portion 63 in the first embodiment of FIG. 2. In this case, the contact between the outer circumferential surface of the rubber member 70 and the inner circumferential surface of the ring member 80 is secured in the range from the front end position P4 of the region 73H of the rubber member 70, which is brought into contact with the exposure portion 63 of the metal connector member 60, to the rear end position P3 of the ring member 80. Namely, the ring member 80 has a contact portion 85 over the range from the front end position P4 of the region 73H to the rear end position P3 of the ring member 80 as shown in FIG. 2 in the first embodiment. The length from the front end position P4 of the region 73H to the rear end position P3 of the ring member 80 in the axis direction is then defined as the contact length L1. As mentioned above, it is preferable that the contact portion 85 is located at a position axially overlapping at least one of the metal connector member 60 (exposure portion 63) and the resin part 10 and is brought into contact with the outer circumferential surface of the rubber member 70. In the case where the connector member 60 (exposure portion 63) and the contact portion 85 axially overlap in position, it is more preferable for the purpose of vibration resistance improvement to satisfy the condition of $0.97 \leq (S1/S2) \leq 0.99$ where S1 is the area inside a circle representing the inner circumferential surface of the contact portion 85 and outside a circle representing the outer circumferential surface of the connector member 60 (exposure portion 63).

(5) The shapes of the ring members and the methods of fixing of the ring members to the rubber members in the above embodiments are merely examples and are not limited to these examples. For instance, FIGS. 8(A), 8(B), 8(C) and 9(A), 9(B), 9(C) show modified examples of the ring member 80 and the rubber member 70 of FIG. 2.

Figure 8A:
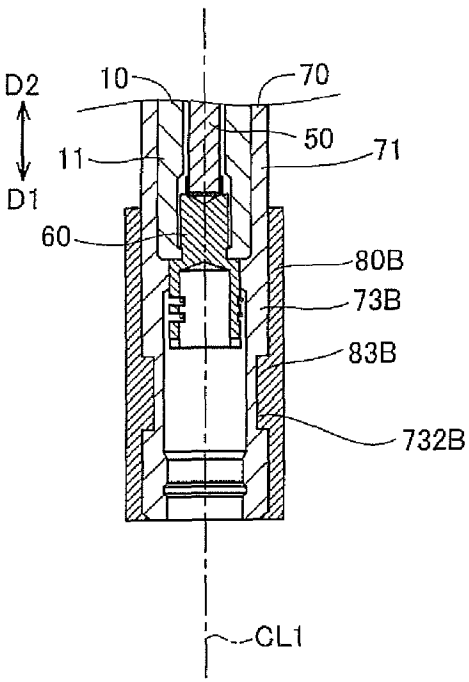
FIG. 8 is a first schematic view showing ring members and rubber members according to modifications of the present invention.

The ring member 80B of FIG. 8(A) has a protrusion 83B formed at an axially middle location on an inner circumferential surface thereof. The protrusion 83B extends over the entire circumference of the inner circumferential surface of the ring member 80B. The plug cover portion 73B of the rubber member of FIG. 8(A) has a recess 732B formed in an outer circumferential surface thereof in accordance with the shape of the protrusion 83B. The ring member 80B is fixed to the rubber member by engagement of the protrusion 83B of the ring member 80 in the recess 732B of the rubber member.

Figure 8B:
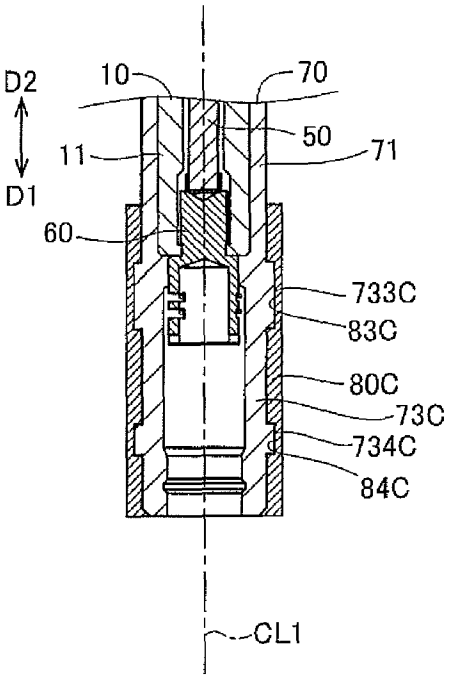

The ring member 80C of FIG. 8(B) has two recesses 83C and 84C formed in an inner circumferential surface thereof. The recesses 83C and 84C extend over the entire circumference of the inner circumferential surface of the ring member 80C. The plug cover portion 73C of the rubber member of FIG. 8(B) has protrusions 733C and 734C formed on an outer circumferential surface thereof in accordance with the respective shapes of the recesses 83C and 84C. The ring member 80C is fixed to the rubber member by engagement of the protrusions 733C and 734C of the rubber member in the recesses 83C and 84C of the ring member 80C.

Figure 8C:
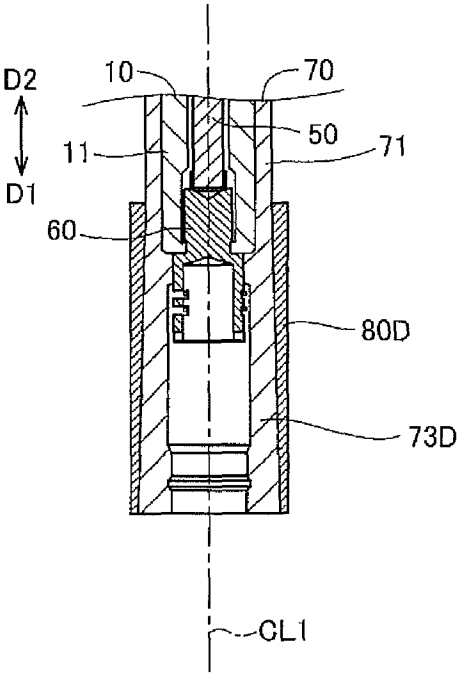

The ring member 80D of FIG. 8(C) has an inner diameter increasing from the second direction D2 side toward the first direction D1 side. The plug cover portion 73D of the rubber member of FIG. 8(C) has an outer diameter increasing from the second direction D2 side toward the first direction D1 side in accordance with the inner diameter of the ring member 80. The ring member 80D is fixed to the rubber member by contact of the diameter-increasing inner circumferential surface of the ring member 80D with the diameter-increasing outer circumferential surface of the plug cover portion 73D. For example, in particular, the ring member 80D is effectively prevented from falling off in the first direction D1. Further, the pressure applied from the inner circumferential surface of the ring member 80D to the outer circumferential surface of the plug cover portion 73D is increased as the axial position of the ring member 80D is shifted in the first direction D1 relative to the plug cover portion 73D. The pressure applied from the ring member 80D to the plug cover portion 73D is hence adjusted to an adequate degree by changing the axial position of the ring member 80D.

Figure 9A:
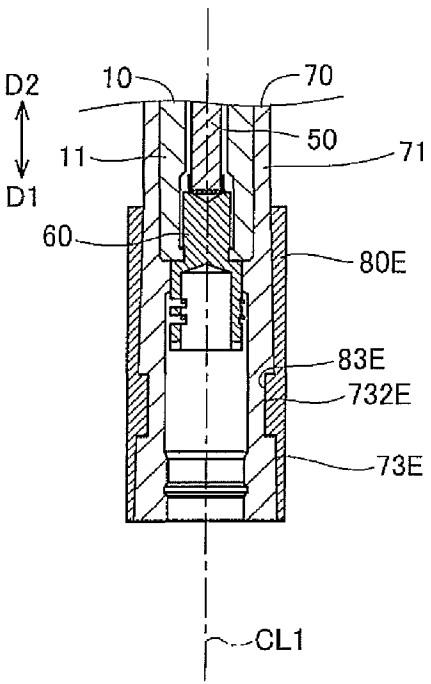
FIG. 9 is a second schematic view showing ring members and rubber members according to modifications of the present invention.

The ring member 80E of FIG. 9(A) has a protrusion 83E formed at an axially middle location on an inner circumferential surface thereof as in the case of the protrusion 80B of FIG. 8(A). As in the case of the plug cover portion 73B of the rubber member of the FIG. 8(A), the plug cover portion 73E of the rubber member of FIG. 9(A) has a recess 732E formed on an outer circumferential surface thereof in accordance with the shape of the protrusion 83E. Further, the ring member 80E of FIG. 9(A) has an inner diameter increasing from the second direction D2 side toward the first direction D1 side as in the case of the ring member 80D of FIG. 8(C). As in the case of the plug cover portion 73D of FIG. 8(C), the plug cover portion 73E of the rubber member of FIG. 9(A) has an outer diameter increasing from the second direction D2 side toward the first direction D1 side in accordance with the inner diameter of the ring member 80E.

In the modified example of FIG. 9(A), the ring member 80E is fixed to the rubber member by not only engagement of the protrusion 83E of the ring member 80E in the recess 732E of the rubber member but also contact of the diameter-increasing inner circumferential surface of the ring member 80E with the diameter-increasing outer circumferential surface of the plug cover portion 73E. It is thus possible to more firmly fix the ring member 80E to the rubber member.

Figure 9B:
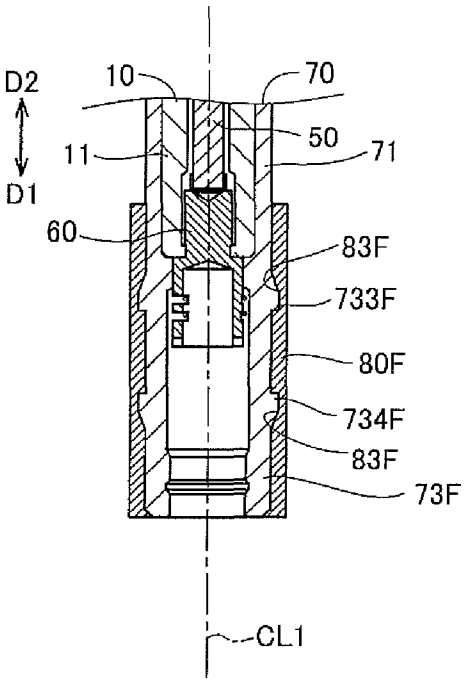

The ring member 80F of FIG. 9(B) has two recesses 83F and 84F formed in an inner circumferential surface thereof. Differently from the recess 83C of FIG. 8(B), the recess 83F has a second direction D2 side region gradually increasing in diameter from the second direction D2 side toward the first direction D1 side. Differently from the recess 84C of FIG. 8(B), the recess 84F has a first direction D1 side region gradually decreasing in diameter from the second direction D2 side toward the first direction D1 side. Further, the plug cover portion 73F of the rubber member of FIG. 9(B) has protrusions 733F and 734F formed on an outer circumferential portion thereof in accordance with the respective shapes of the recesses 83F and 84F. The ring member 80F is fixed to the rubber member by engagement of the protrusions 733F and 734F of the rubber member in the recesses 83F and 84F of the ring member 80F.

Figure 9C:
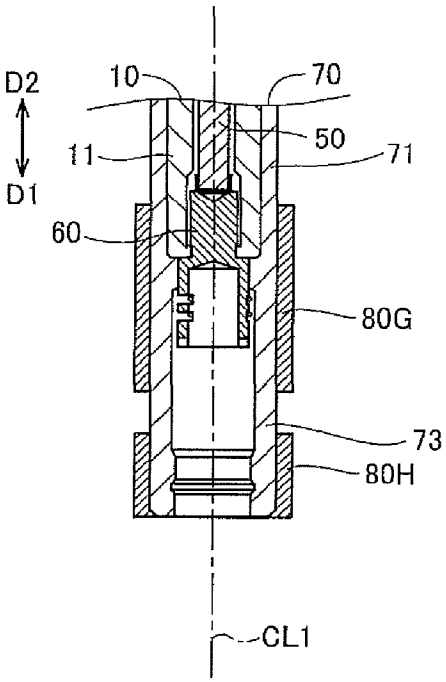

In the modified example of FIG. 9(C), two ring members 80G and 80H are provided. The metal connector member 60 and the resin part 10 are arranged radially inside the ring member 80G. The insulator IN of the spark plug SP is arranged radially inside the ring member 80H. In this case, vibration of the plug cap is suppressed by the ring member 80G; whereas the entry of water is avoided by the ring member 80H. It is thus possible to improve the current leakage resistance of the plug cap.

Figure 10A:
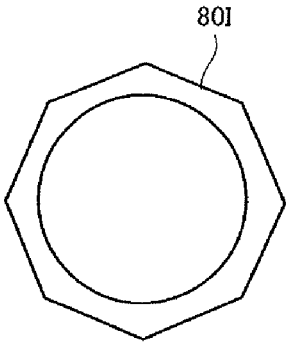
FIG. 10 is a schematic view showing ring members according to modifications of the present invention.
Figure 10B:
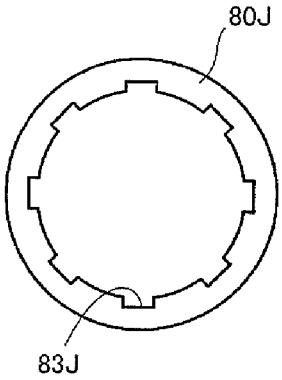
Figure 10C:
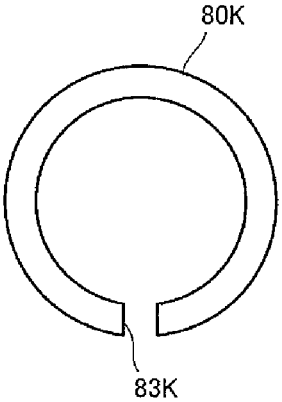

(6) In the above embodiments, the ring member 80 is not necessarily perfect circular in shape when viewed in the axis direction and can be provided in various shapes. FIG. 10 shows modified examples of the ring member. The ring member 80I of FIG. 10(A) has an outer circumferential surface formed in a polygonal shape, more specifically, octagonal shape when viewed in the axis direction. The ring member 80J of FIG. 10(B) has a plurality of grooves 83J formed in an inner circumferential surface thereof such that the grooves 83J extend in the axial direction. Against the ring member 80J of FIG. 10(B), the plug cover portion 73 of the rubber member may or may not have a plurality of protrusions formed on an outer circumferential surface thereof such that the protrusions extend in the axis direction and engage in the grooves 83J. The ring member 80K of FIG. 10(C) has a cut 83K. As shown in FIG. 10(A) to (C), it is sufficient that the ring member is substantially ring-shaped when viewed in the axis direction. The ring member may have a recess, a protrusion or a linear region on the inner or outer circumferential surface thereof or may have a cut in the part thereof. It is feasible to form the ring member in any shape regarded as substantially ring shape.

(7) The specific structure of the plug cap 100 as shown in FIG. 1 is merely one example and is not limited to this example. For instance, the axial positions of the resistor 50 and the connection spring 40 may be opposite. The first and second holes 11A and 12A of the resin part 10 may be formed as a single curved hole. In such a case, it is feasible to omit the metal plate 30 and electrically connect the cord fixing screw 20 and the resistor 50 via a curved connection spring.

(8) The respective component materials of the plug cap 100 of FIG. 1 are not limited to the above-exemplified materials. For example, the resistor 50 can be a wire-wound resistor rather than a resistor of a ceramic material. Further, various materials such as metal materials, conductive resin materials and conductive ceramic materials are usable as the materials of the metal connector member 60, the cord fixing screw 20 and the spring 40. Although the resin part 10 of FIG. 2 is made of thermosetting resin e.g. unsaturated polyester resin or phenol resin, various insulating materials such as thermoplastic resin e.g. nylon or PPS resin can alternatively be used as the material of the resin part 10.

(9) The material of the ring member 80 is not limited to the above-exemplified material. As the material of the ring member 80, it is feasible to use not only a thermosetting resin (such as unsaturated polyester resin or phenol resin) but also any other material having higher hardness than that of the rubber member 70. For example, the ring member 80 can be made of a metal material.

Although the present invention has been described with reference to the above specific embodiments and modifications, the above embodiments and modifications are intended to facilitate understanding of the present invention and are not intended to limit the present invention thereto. Without departing from the scope of the present invention, various changes and modifications can be made to the present invention; and the present invention includes equivalents thereof.

INDUSTRIAL APPLICABILITY

The present invention is suitably applicable to a plug connector such as plug cap and to a rubber member and a ring member of the plug connector.

DESCRIPTION OF REFERENCE NUMERALS

3: Connector spring
10: Resin part
11: First structure portion
11A: First hole
12: Second structure portion
12A: Second hole
20: Cord fixing screw
30: Metal plate
40: Connection spring
50: Resistor
60: Metal connector member
61: Head portion
63: Exposure portion
65: Plug insertion hole
70: Rubber member
71: First body portion
72: Second body portion
73: Plug cover portion
74: Cord cover portion
75: Fixing portion
80, 80B to 80K: Ring member
100: Plug cap
200: Plug cord
300: Ignition coil-integrated plug cap
310: Coil unit
315: Connector
320: Output terminal
SP: Spark plug Having described the invention, the following is claimed:

1. A plug connector for supplying power to a spark plug from a power supply member, the spark plug including an insulator and a terminal electrode that rearwardly protrudes from a rear end of the insulator, the plug connector comprising:

a conductive part configured to enable an electrical connection between the spark plug and the power supply member;

a rubber member that covers the conductive part;

at least one ring member arranged on an outer circumference of the rubber member and having a hardness that is greater than a hardness of the rubber member; and a high hardness part covered by the rubber member and arranged on an outer circumference of the conductive part, a front end of the high hardness part being located rearward of an area of the conductive part at which the terminal electrode is positioned to enable the electrical connection between the spark plug and the power supply member, the front end of the high hardness part being located rearward of the terminal electrode when the plug connector is attached to the spark plug, the high hardness part having a hardness that is greater than the hardness of the rubber member.

2. The plug connector according to claim 1, wherein the conductive part includes a metal connector member configured to accept the terminal electrode therewithin to enable the electrical connection between the spark plug and the power supply member; and wherein a rear end of the at least one ring member is located rearward of a front end of the metal connector member.

3. The plug connector according to claim 1, wherein a rear end of the at least one ring member is located rearward of the front end of the high hardness part.

4. The plug connector according to claim 1, wherein the rubber member has at least one of a recess and a protrusion formed on an outer circumferential surface thereof according to a shape of an inner circumferential surface portion including at least a part of an inner circumferential surface of the at least one ring member.

5. The plug connector according to claim 1, further comprising a metal connector member connectable to the terminal electrode and covered by the rubber member, wherein the at least one ring member includes a contact portion located at a position overlapping at least one of the metal connector member and the high hardness part in an axis direction, the contact portion being in contact with an outer circumferential surface of the rubber member.

6. The plug connector according to claim 5, wherein, in a cross section taken through the contact portion in a direction perpendicular to the axis direction, an inner circumferential surface of the contact portion is in a shape of a first circle, and an outer circumferential surface of the at least one of the metal connector member and the high hardness part is in a shape of a second circle smaller in diameter than the first circle; and wherein the plug connector satisfies a condition of $0.97 \leq (S1/S2) \leq 0.99$ where, in the cross section, S1 is an area inside the first circle and outside the second circle, and S2 is an area of the rubber member before arrangement of the at least one ring member.

7. The plug connector according to claim 5, wherein the contact portion has a first protrusion protruding radially inwardly from an inner circumferential surface thereof, the first protrusion being in contact with the outer circumferential surface of the rubber member.

8. The plug connector according to claim 5, wherein the rubber member has a second protrusion protruding radially outwardly from the outer circumferential surface thereof, the second protrusion being in into contact with an inner circumferential surface of the contact portion.

9. The plug connector according to claim 5, wherein the contact portion has a length of 10 mm or smaller in the axis direction.

* * * * *